US006401844B1

(12) United States Patent
Doster et al.

(10) Patent No.: US 6,401,844 B1
(45) Date of Patent: Jun. 11, 2002

(54) CUTTER WITH COMPLEX SUPERABRASIVE GEOMETRY AND DRILL BITS SO EQUIPPED

(75) Inventors: Michael L. Doster, Spring; Rudolf C. O. Pessier, Houston, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/205,138

(22) Filed: Dec. 3, 1998

(51) Int. Cl.[7] ..... E21B 10/46
(52) U.S. Cl. ..... 175/432; 175/434
(58) Field of Search ..... 125/428, 432, 125/374, 433, 434

(56) References Cited

U.S. PATENT DOCUMENTS

| | | | | |
|---|---|---|---|---|
| 5,379,853 A | | 1/1995 | Lockwood et al. | |
| 5,590,727 A | | 1/1997 | Tank et al. | |
| 5,590,728 A | | 1/1997 | Matthias et al. | |
| 5,590,729 A | | 1/1997 | Cooley et al. | |
| 5,605,198 A | | 2/1997 | Tibbitts et al. | |
| 5,662,720 A | | 9/1997 | O'Tighearnaigh | |
| 5,667,028 A | | 9/1997 | Truax et al. | |
| 5,788,001 A | | 8/1998 | Matthias et al. | |
| 5,928,071 A | * | 7/1999 | Devlin | 175/432 |
| 5,979,578 A | | 11/1999 | Packer | |
| 6,003,623 A | | 12/1999 | Miess | |
| 6,011,232 A | | 1/2000 | Matthias | 219/69.17 |
| 6,029,760 A | * | 2/2000 | Hall | 175/432 |
| 6,045,440 A | * | 4/2000 | Johnson et al. | 175/432 |
| 6,082,474 A | * | 7/2000 | Matthias | 175/432 |
| 6,145,607 A | | 11/2000 | Griffin et al. | |

* cited by examiner

*Primary Examiner*—William Neuder
(74) *Attorney, Agent, or Firm*—TraskBritt

(57) ABSTRACT

A cutter comprising a superabrasive volume including a cutting face portion extending transversely across a leading face of a supporting substrate and a contiguous jacket portion extending rearwardly over the supporting substrate along a portion of its side periphery. Interfaces between the respective superabrasive volume cutting face and cap portions and adjoining surfaces of the supporting substrate are each irregular. The leading face of the substrate includes grooves extending toward the jacket at least partially across the leading face from the side of the substrate opposite the jacket. The side periphery of the substrate defining the location of the jacket is grooved at a plurality of laterally-adjacent locations with substantially axially-oriented grooves extending rearwardly from the leading face of the substrate to a position closer to the trailing face of the substrate. At least one ridge intermediate the side grooves may not extend radially outwardly to a full diameter of the substrate so that the superabrasive material of the jacket extends not only into the circumferential grooves but also circumferentially therebetween, providing a continuous, arcuate superabrasive surface which may have substantially the same exterior diameter as that of the substrate itself. Rotary drill bits for subterranean drilling bearing cutters according to the present invention are also disclosed.

72 Claims, 7 Drawing Sheets

CUTTER WITH COMPLEX SUPERABRASIVE GEOMETRY AND DRILL BITS SO EQUIPPED

BACKGROUND OF THE INVENTION

1. Field of the Invention

The present invention relates to cutters for use on rotary drill bits for drilling subterranean formations and, more specifically, to a cutter including a superabrasive table including a cutting face and a side jacket over a supporting substrate, as well as rotary drill bits carrying such cutters.

2. State of the Art

Superabrasive materials, normally diamond, have been employed in cutting elements for rotary drill bits for decades. For about the past twenty-five years there has been widespread use of synthetic diamond cutters, specifically in the form of polycrystalline diamond compacts. Polycrystalline diamond compact cutters, commonly known as PDCs, have been commercially available for over 20 years. PDCs may be self-supporting, or may comprise a diamond "table" bonded during formation to a supporting substrate. A diamond table/substrate cutter structure is formed by stacking into a cell layers of fine diamond crystals (100 microns or less) and metal catalyst powder, alternating with wafer-like metal substrates of cemented tungsten carbide or other suitable materials. In some cases, the catalyst material may be incorporated in the substrate in addition to or in lieu of using a powder catalyst intermixed with the diamond crystals. A loaded receptacle is subsequently placed in an ultra-high temperature (typically 1450–1600° C.) ultra-high pressure (typically 50–70 kilobar) diamond press, wherein the diamond crystals, stimulated by the catalytic effect of the metal powder, bond to each other and to the substrate material. The spaces in the diamond table between the diamond to diamond bonds are filled with residual metal catalyst. A so-called thermally stable PDC product (commonly termed as "TSP") may be formed by leaching out the metal in the diamond table. Alternatively, silicon, which possesses a coefficient of thermal expansion similar to that of diamond, may be used to bond diamond particles to produce a Si-bonded TSP. TSPs are capable of enduring higher temperatures (on the order of 1200° C.) without degradation in comparison to normal PDCs, which experience thermal degradation upon exposure to temperatures of about 750–800° C.

While PDC and TSP cutters employed in rotary drag bits for earth boring have achieved major advances in obtainable rate of penetration while drilling and in greatly expanding the types of formations suitable for drilling with diamond bits at economically viable cost, the diamond table/substrate configurations of state of the art cutters, typically employing substantially planar superabrasive tables having a variety of interface configurations with a supporting substrate, leave something to be desired.

First, bending, attributable to the loading of the cutting element by the formation, may cause fracture or even delamination of the diamond table from the substrate. It is believed that such degradation of the cutting element is due, at least in part, to lack of sufficient stiffness of the cutting element so that when encountering the formation the diamond table actually flexes due to lack of sufficient rigidity or stiffness. As diamond has an extremely low strain to failure (diamond cannot tolerate large values of absolute strain), only a small amount of flex can initiate fracture. In addition, fracture may also be initiated in the highly stressed carbide substrate when cutting loads are applied to the cutting element, as the carbide is stressed in tension during cooling after the previously-described fabrication process due to the difference in coefficients of thermal expansion between the diamond and the substrate material.

A second limitation of PDCs is due to excessive buildup of heat due to frictional forces generated during the cutting process. While the superabrasive material of the cutting element table has an extremely high thermal conductivity (on the order of 400 to over 600 watts/meter Kelvin) and the substrate has a relatively high thermal conductivity (on the order of 100 watts/meter Kelvin), the bit body, typically steel or WC matrix, has a far lower thermal conductivity (on the order of 30 watts/meter Kelvin). As the cutting element wears and the point of contact with the formation becomes an ever-wider wear flat, the cutting element is subjected to higher cutting energies and the substrate becomes ever-smaller, limiting and actually reducing the potential rate of heat transfer. The heat buildup causes overheating of the cutting element and accelerated wear of the diamond table and supporting substrate. In "dull" or used bits, such excessive heating is often manifested on the WC substrate behind the diamond table by the phenomenon of "heat checking", which comprises vertically running fractures in a checkerboard pattern.

It has been proposed to enhance the stiffness of superabrasive cutting elements by providing the superabrasive table with a linearly-extending portion of enhanced thickness. Such a configuration provides additional stiffness for the cutting structure, and also beneficially increases compressive stresses in the superabrasive material table while lowering tensile stresses in the supporting substrate. A number of variations of this approach are described in co-pending U.S. Pat. No. 5,435,403 to Gordon A. Tibbitts, assigned to the assignee of the present invention and incorporated herein by this reference.

It has also been proposed to provide superabrasive cutters with diamond tables including one or more struts or other protrusions of superabrasive material extending rearwardly into the substrate to enhance stiffness of the table, as well as, or alternatively, to enhance heat transfer from the cutting edge and cutting face of the diamond table. U.S. Pat. No. 5,590,729 to Cooley et al., assigned to the assignee of the present invention and incorporated herein by this reference, discloses a variety of such cutters.

Yet another advance in the art was the recognition that cutters in different locations on drill bits experience loading of different magnitudes and types during a drilling operation, and that cutters might be designed and selected to best accommodate loading at the different locations. U.S. Pat. No. 5,605,198 to Tibbitts et al., assigned to the assignee of the present invention and incorporated herein by this reference, discloses such design and selective placement of cutters.

U.S. Pat. No. 5,590,727 to Tank discloses several cutter configurations employing a stepped interface between superabrasive material and a supporting substrate, the superabrasive material extending down an exterior side of the cutter.

U.S. Pat. No. 5,667,028 to Truax et al. discloses a variety of cutter configurations employing so-called "secondary" PDC cutting surfaces placed on the side of the substrate in spaced relationship to the PDC diamond table, the secondary cutting surfaces purportedly reducing the rate of erosion of the substrate material during drilling.

However, despite the above-referenced developments, significant shortcomings are still exhibited by conventional cutters in certain situations. For example, erosion or abrasion of the cutter substrate immediately to the rear of the superabrasive table results in the beneficial formation of a protruding "lip" of superabrasive material and conventional thought is to the effect that the presence of such a lip facilitates the cutting action of the cutter. However, the inventors herein have recognized that the well-known phenomenon of so-called bit "whirl", wherein a bit rotates or precesses in the borehole counter to the direction of bit rotation by the drill string or downhole motor, may result in the superabrasive lip "catching" on the uncut formation of the borehole bottom or wall so that the superabrasive table is placed in tension, precipitating delamination of the table from the substrate. Further, the inventors have recognized that in more ductile, elastic formations, subsequent to shearing of formation material by the superabrasive table of a cutter, the still-uncut formation adjacent the cutter rebounds and contacts the substrate to the rear of the table. This phenomenon, occurring on a continuing basis as the bit rotates, results in the aforementioned heat checking of the substrate and attendant breakdown in physical support for the superabrasive table.

Accordingly, there remains a significant need in the art for improvements in cutter integrity, impact resistance and heat transfer capabilities.

BRIEF SUMMARY OF THE INVENTION

The present invention includes a cutter comprising a superabrasive volume including a cutting face portion extending transversely across at least a portion of a leading end of a supporting substrate and a contiguous jacket portion extending rearwardly over the supporting substrate along a portion of its side periphery comprising a surface of revolution. Interfaces between the respective superabrasive volume cutting face and jacket portions and adjacent exterior surfaces of the supporting substrate are each irregular. More specifically, the leading face of the substrate may include one or more grooves extending toward the jacket at least partially across the leading face from the side of the substrate opposite the jacket, the superabrasive material extending into the grooves. Similarly, the side periphery of the substrate defining the location of the jacket may be grooved at one or more adjacent locations with substantially axially-oriented grooves extending rearwardly from the leading end of the substrate to a position closer to the trailing end of the substrate. Substantially axially-oriented ridges intermediate the side periphery grooves may not extend radially outwardly to a full radius of the adjacent substrate portion so that the superabrasive material of the jacket extends not only into the circumferential grooves but also circumferentially therebetween, providing a continuous, arcuate superabrasive surface having substantially the same exterior radius as that of the substrate portion adjacent the jacket. Alternatively, if the ridges extend to the full radius of the substrate portion adjacent the jacket, the jacket may comprise mutually adjacent but separate ribs of superabrasive material rather than a continuous surface.

The asymmetrical design of the inventive cutter provides a significant substrate surface area for brazing of the cutters into pockets on the face of a bit while protecting the carbide material of the cutter substrate on the bottom side of the cutter (as the cutter is normally oriented on the bit), as well as the interface between the superabrasive table and the substrate.

Rotary drill bits for subterranean drilling bearing cutters according to the present invention are also included within the scope of the invention.

DETAILED DESCRIPTION OF THE INVENTION

Figure 1:
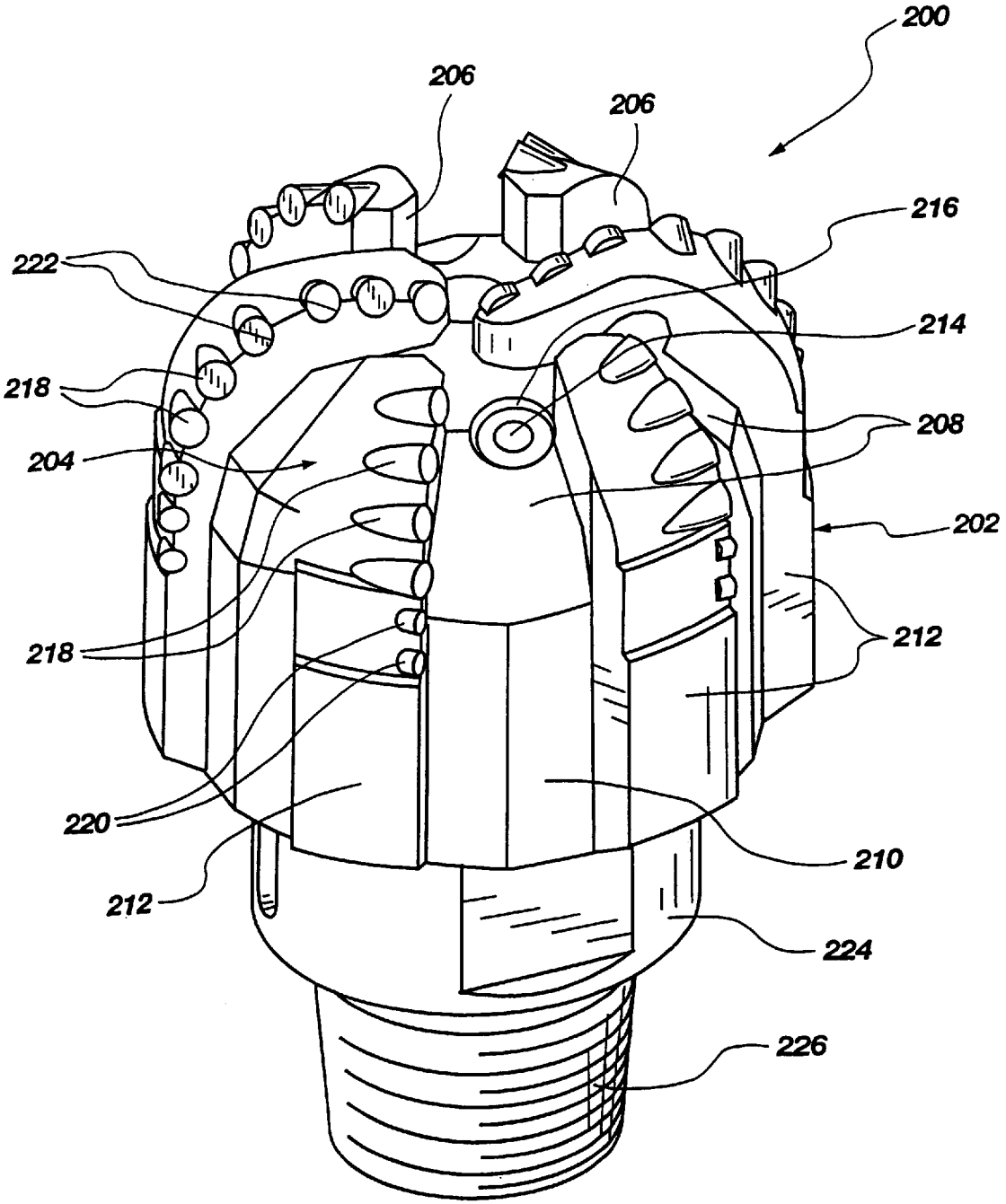
FIG. 1 is a perspective view, inverted from a normal drilling position, of a rotary drag bit bearing cutters according to the present invention.
Figure 2:
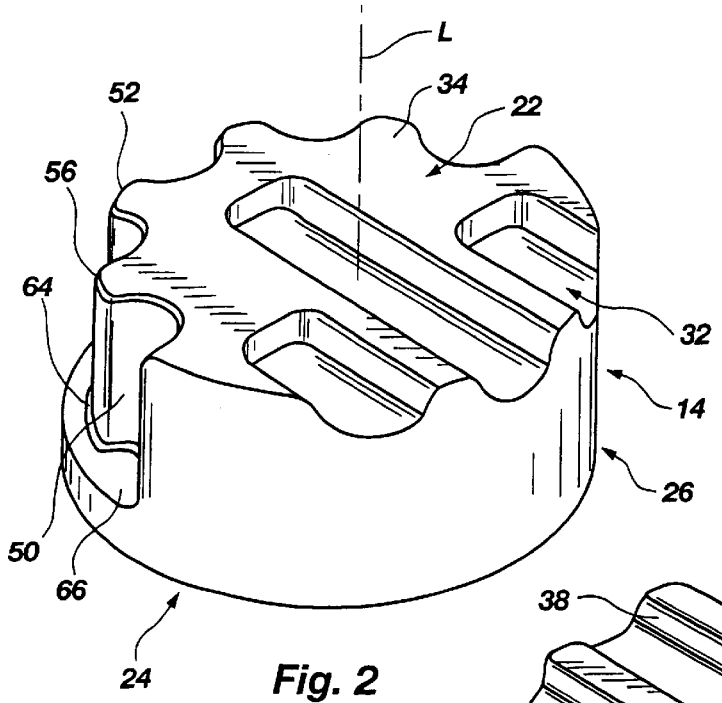
FIG. 2 is a first perspective view of a substrate of a first embodiment of a cutter according to the present invention.
Figure 3:
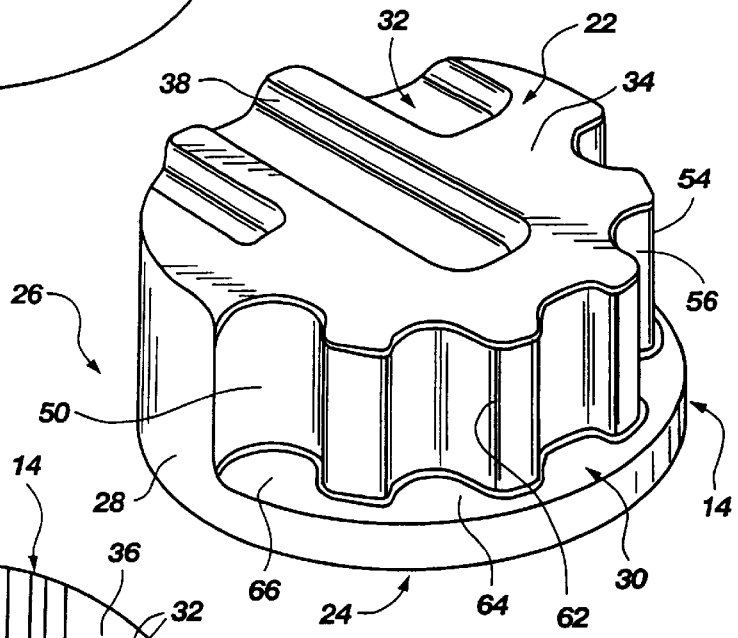
FIG. 3 is a second perspective view of the substrate of FIG. 2.
Figure 4:
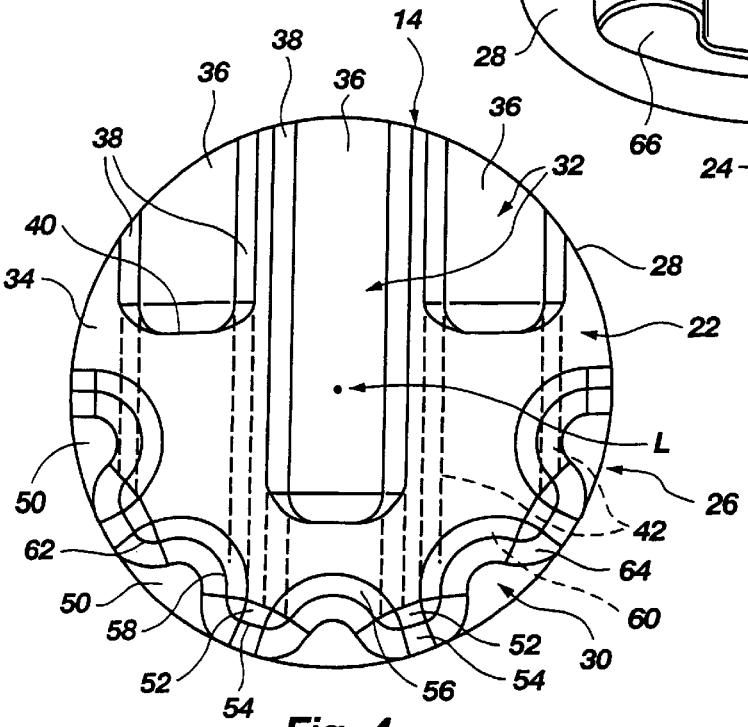
FIG. 4 is a frontal elevation of the substrate of FIG. 2.

Referring now to FIG. 1 of the drawings, an exemplary rotary drag bit 200 is depicted. Bit 200 includes a bit body 202 having a face 204, above which extends a plurality of blades 206. Fluid courses 208 on the face 204 extend radially outwardly between blades 206 and communicate with junk slots 210 located between gage pads 212, which in this instance comprise longitudinal extensions of blades 206. Nozzles 214 located in apertures 216 in bit face 204 provide drilling fluid flow to remove formation cuttings from the bit face and cool and clean the superabrasive cutters 218 on blades 206. Smaller diameter superabrasive cutters 220 act as gage trimmers to maintain the borehole gage drilled by the bit 200. As shown, cutters 218 and 220 are brazed or otherwise secured in pockets 222 formed on the blades during fabrication of bit 200. Bit shank 224 includes a threaded pin connection 226 thereon for securing bit 200 to a drill string or a downhole motor at the end of a drill string, as known in the art. A central bore (not shown) leading through bit shank 224 introduces drilling fluid received from the drill string or motor into a plenum or discrete passages extending to apertures 216 in bit face 204, again as known in the art. At least some of superabrasive cutters 218 and 220 comprise cutters according to the present invention as will be hereinafter described with respect to FIGS. 2–12 of the drawings. As noted above, bit 200 is exemplary only and is in no way limiting as to the design or style of bit on which the cutters according to the present invention may be placed.

Referring now to FIGS. 2 through 5 of the drawings, features of a first cutter embodiment 10 according to the present invention comprise a superabrasive volume 12 formed onto a supporting substrate 14 according to ultra-high temperature, ultra-high pressure techniques referenced above and well known in the art. The superabrasive volume preferably comprises a PDC, although it may optionally comprise a TSP or a cubic boron nitride compact. The supporting substrate preferably comprises a cemented tungsten carbide structure, preformed and placed in a diamond press with diamond crystals and a catalyst. Superabrasive processes being well known in the art, no further description thereof is necessary.

Superabrasive volume 12 (see FIG. 5) comprises a cutting face 16 extending in two dimensions substantially transverse to longitudinal axis L of cutter 10 and having a cutting edge 18 at a lateral periphery thereof. Superabrasive volume 12 also includes a contiguous jacket 20 extending rearwardly from cutting edge 18 over the side of substrate 14.

Substrate 14, as shown, (see particularly FIGS. 2–4) is substantially cylindrical and includes a leading end 22, a trailing end 24, and a side periphery 26. A portion 28 of the side periphery 26 comprises a surface of revolution, while another portion 30 lies inset from the surface of revolution and defines the location of superabrasive jacket 20 on the side periphery 26 of substrate 14.

Leading end 22 of substrate 14 comprises an irregular surface including a plurality of mutually parallel grooves 32 in substantially planar surface 34 extending from side periphery 26 from a location substantially opposed to portion 30 of side periphery 26 of substrate 14, and toward portion 30. Grooves 32 preferably include concave bottoms 36 and convex, radiused side borders 38 transitioning from substantially planar surface 34 to concave bottoms 36 of substantially constant radius. Grooves 32 may terminate by tapering arcuately into substantially flat ends 40, into which side borders 38 also taper. Alternatively, as shown in broken lines 42, grooves 32 may extend completely across leading end 22.

Portion 30 of the side periphery 26 comprises a plurality of axially-extending, circumferentially spaced grooves 50, between which lie axially-oriented ridges 52 of substantially constant radius with respect to axis L, the radially outer surfaces 54 of which terminate short of the surface of revolution defined by portion 28 of the side periphery 26. Convex, radiused end borders 56 lead from substantially planar surface 34 of leading end 22 to leading edges of concave bottoms 58 of grooves 50 and leading edges of ridges 52. If, as noted above, leading end grooves 32 extend across leading end 22 to intersect some or all of side periphery grooves 50, the intersections 60 of the mutually perpendicular grooves 32 and 50 may be similarly radiused. The borders 62 between ridges 52 and side groove bottoms 58 are also convex and radiused, as are the borders 64 respectively between grooves 50 and ridges 52 and semi-annular floor 66, which lies near trailing end 24 of substrate 14 and is substantially transverse to longitudinal axis L.

Figure 5:
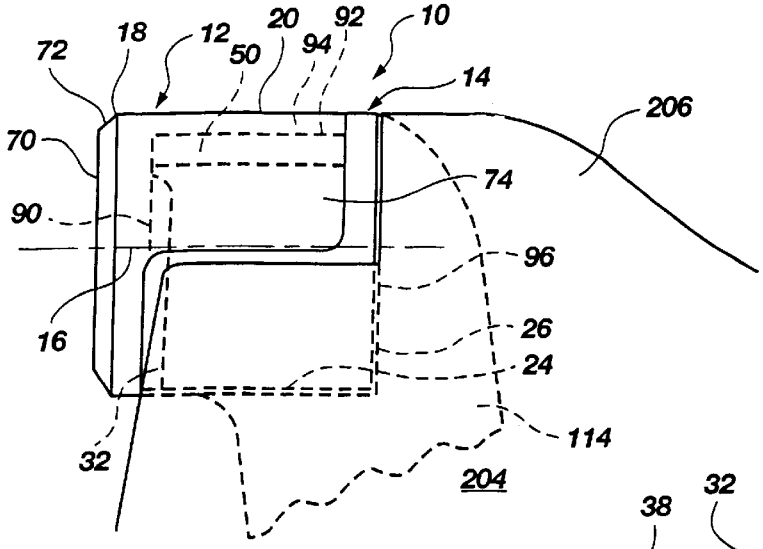
FIG. 5 is a side elevation of the first embodiment of a cutter of the present invention.

As best shown in FIG. 5, cutting face 16 of superabrasive volume 12 may comprise a substantially planar leading surface 70 extending at least partially across leading end 22 of substrate 14, and may include a peripheral chamfer 72 at least adjacent cutting edge 18. As used herein, the term "substantially planar" includes not only flat leading surfaces but those of concave, convex, grooved, stepped, ridged and other configurations which nonetheless extend in two dimensions substantially transverse to longitudinal cutter axis L. Jacket 20 preferably includes a convex exterior surface 74 of substantially the same radius as that of portion 30 of side periphery 26 and coaxial therewith so that the substrate 14 and overlying jacket 20 define a single surface of revolution. Exemplary interior details of some of the grooves 32 and 50 in substrate 14 are shown in FIG. 5 for clarity.

It should be noted that the material of superabrasive volume 12 extends into both grooves 32 and 50, defining ribs 90 and 92, which in substantial part provide the aforementioned irregular interfaces between the superabrasive volume 12 and substrate 14. The above-noted radially foreshortened nature of the ridges 52 provides a continuous shell 94 of superabrasive material over ribs 92, while cutting face 16 extends in a continuous manner over ribs 90. Alternatively, although not currently preferred for all drilling applications, ridges 52 may extend to the full radius of cutter 10 so that ribs 92 are exposed on the side surface of the substrate 14.

As shown in FIG. 5, cutter 10 is located in a pocket 222 on a blade 206 of a bit 200, such as is shown in FIG. 1, so that superabrasive jacket 20 faces generally away from bit face 204 and the cemented tungsten carbide of substrate 14 on the inwardly-facing portion of side periphery 26 as well as on the trailing end 24 of substrate 14 are exposed for brazing cutter 10 as shown at 96 into pocket 222.

Also, as shown in FIG. 5, it is notable that cutter 10 may be configured as a so-called "stud" cutter employing a transverse substrate projection 114 shown in broken lines which is receivable in a socket in a face or blade of a steel-bodied bit. With such a substrate configuration, it will be appreciated that only a portion of substrate 14 will be cylindrical, so that the side periphery 26 thereof comprises only a partial surface of revolution. It is also contemplated that the substrate 14 may be entirely or partially of a frustoconical configuration, presenting at least a partially tapered surface of revolution side periphery, as disclosed in the context of a taper of increasing radius behind the cutting face in U.S. Pat. No. 5,460,233 to Meany et al. and in the context of a decreasing radius taper in U.S. Pat. No. 5,377,773 to Tibbitts, each of these patents assigned to the assignee of the present invention and each incorporated herein by this reference.

Figure 6:
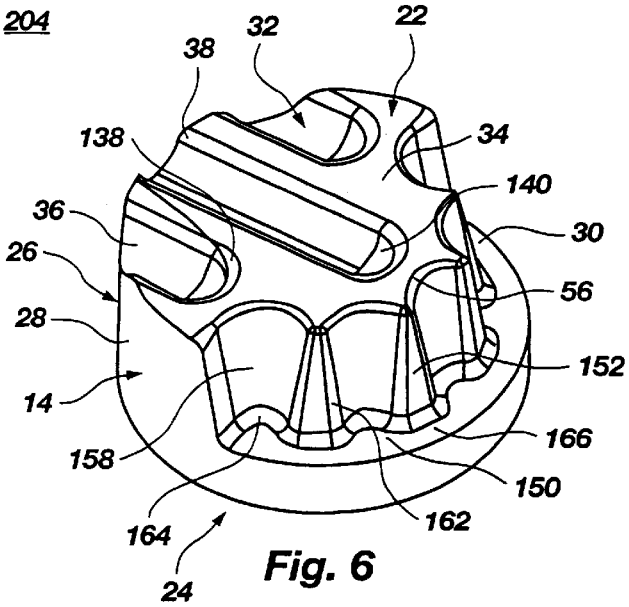
FIG. 6 is a perspective view of a substrate of a second embodiment of a cutter of the present invention.
Figure 7:
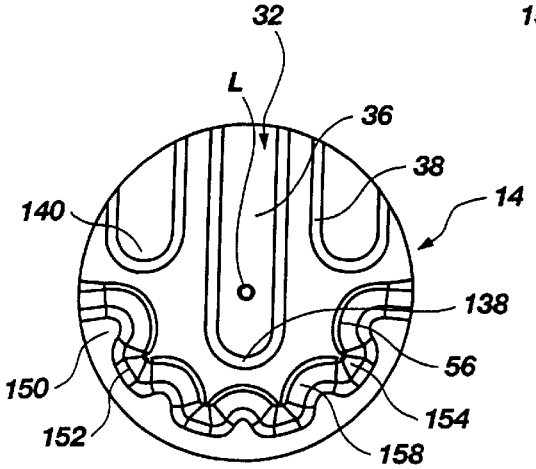
FIG. 7 is a frontal elevation of the substrate of FIG. 6.
Figure 8:
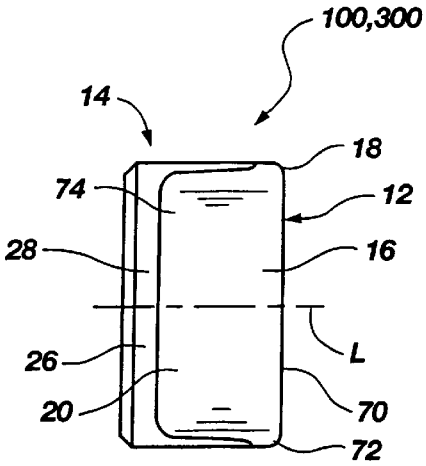
FIG. 8 is a bottom elevation (looking at the cutter from the perspective of the formation being cut) of the second and third embodiments of a cutter of the present invention.
Figure 9:
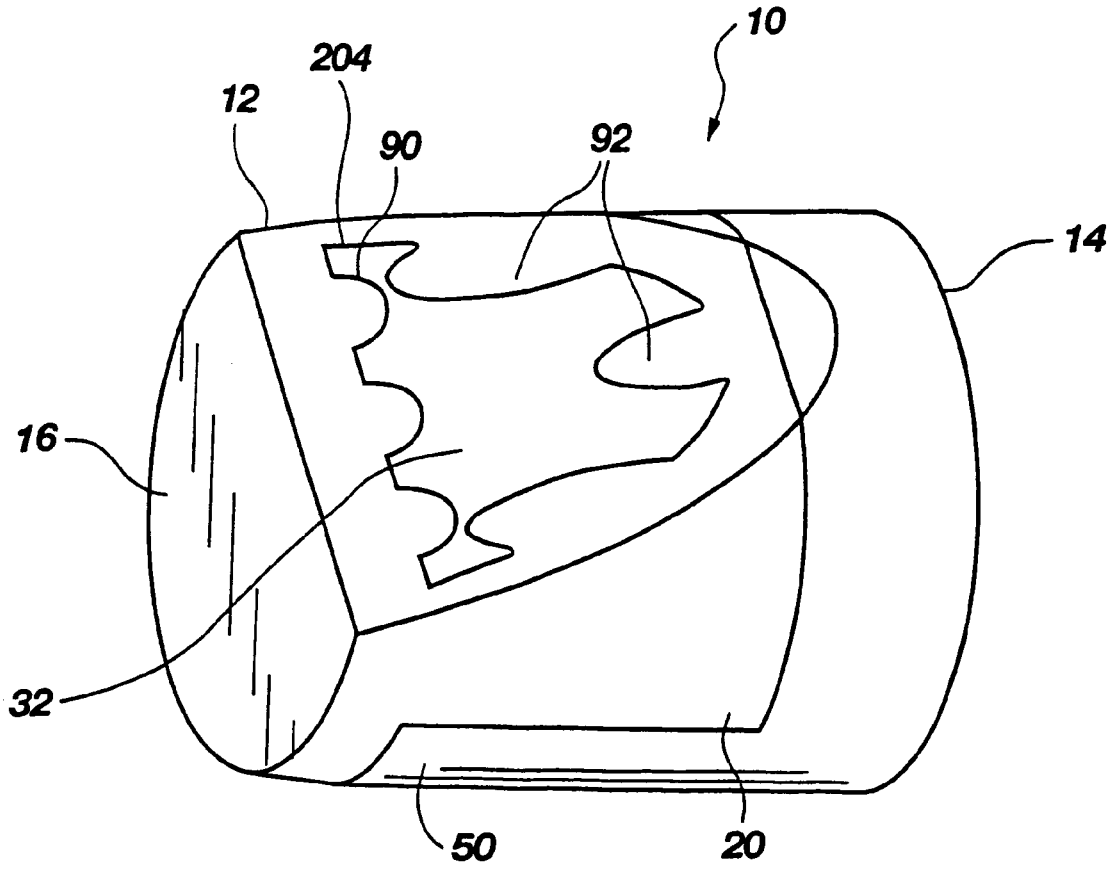
FIG. 9 is a perspective view of an exemplary cutter according to the invention after substantial wear during drilling.
Figure 10:
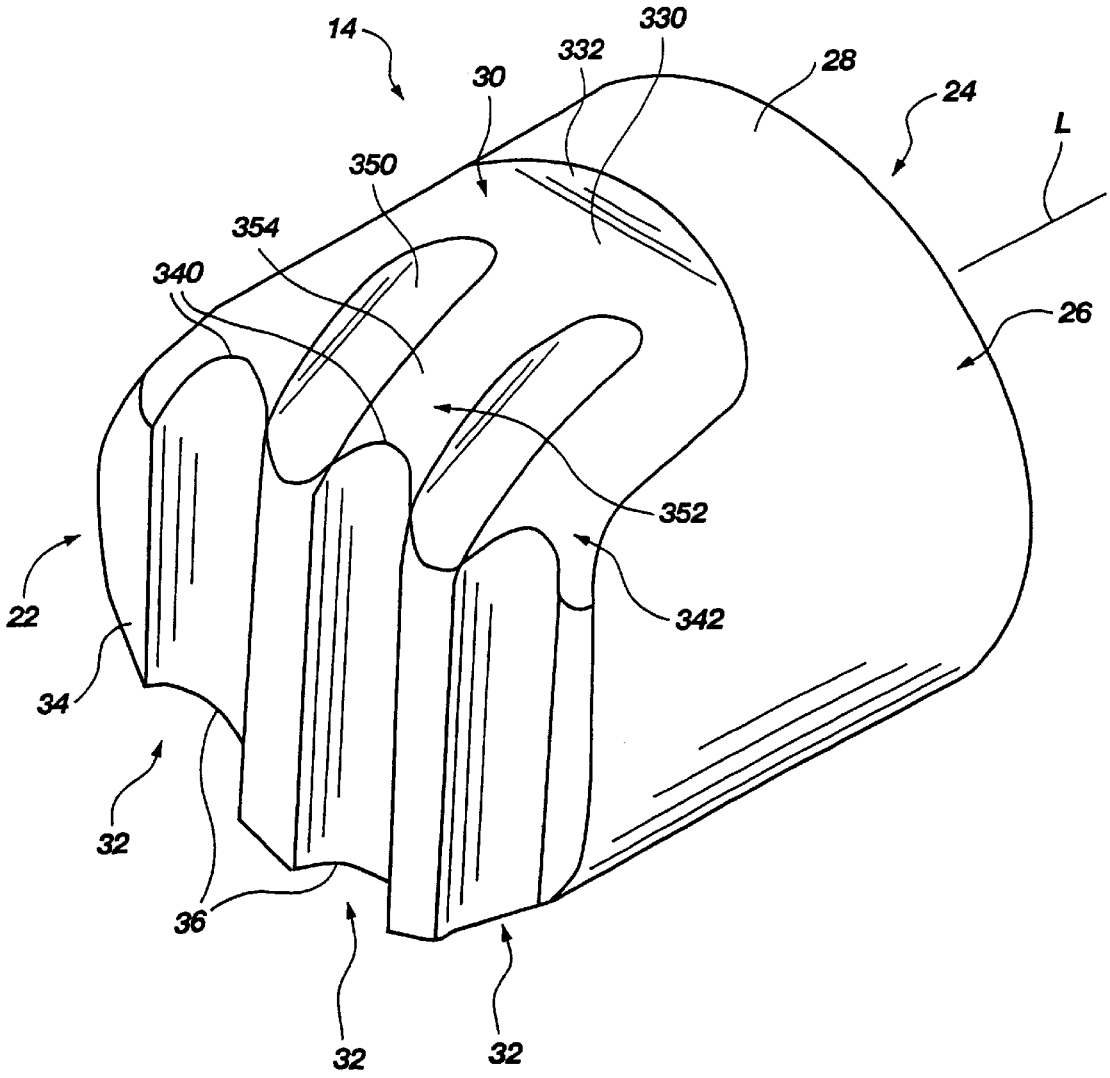
FIG. 10 is a perspective view of a substrate of a third embodiment of a cutter of the present invention as viewed from the front and the side normally adjacent a formation being drilled.
Figure 11:
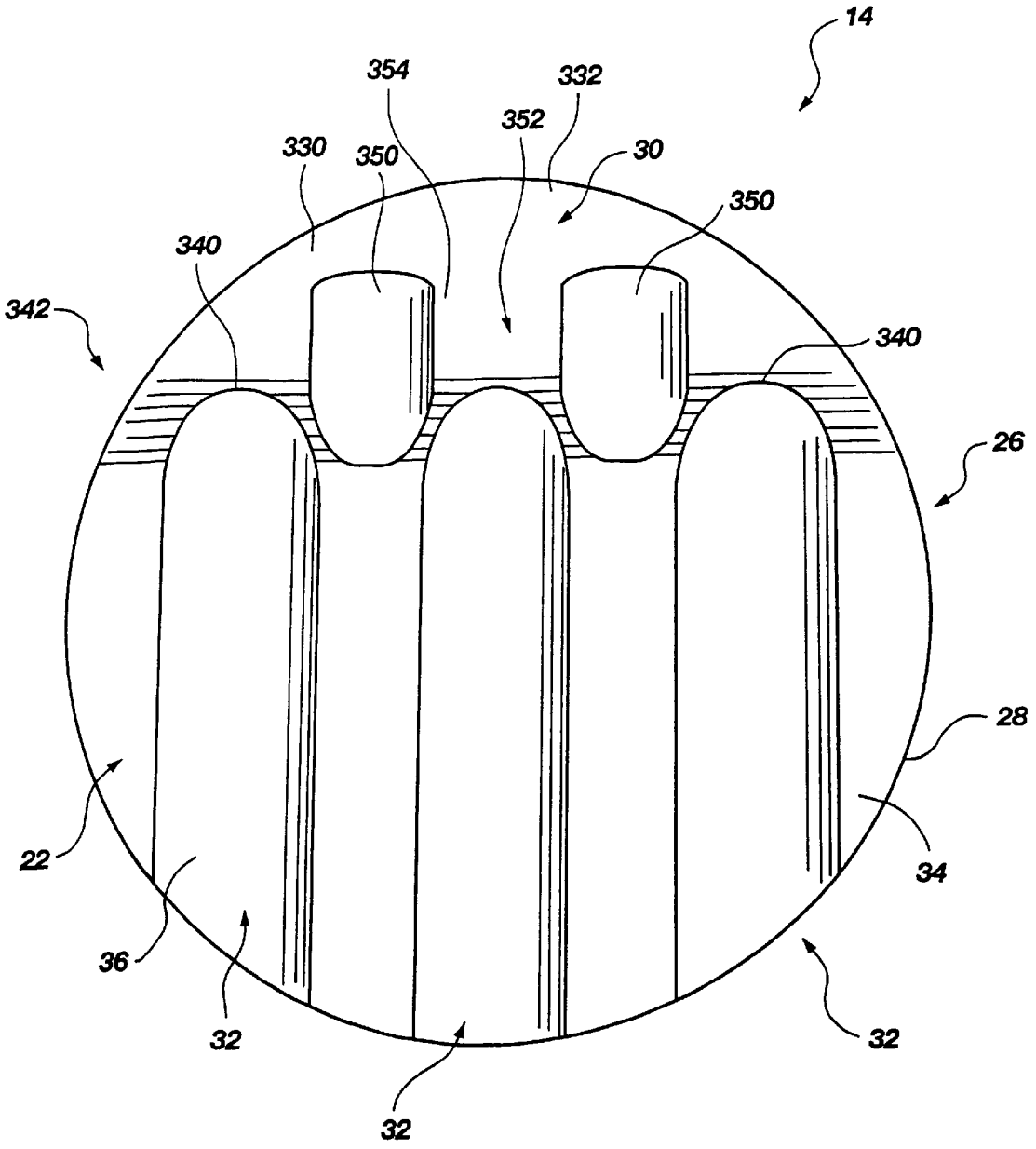
FIG. 11 is a frontal elevation of the substrate of FIG. 10.
Figure 12:
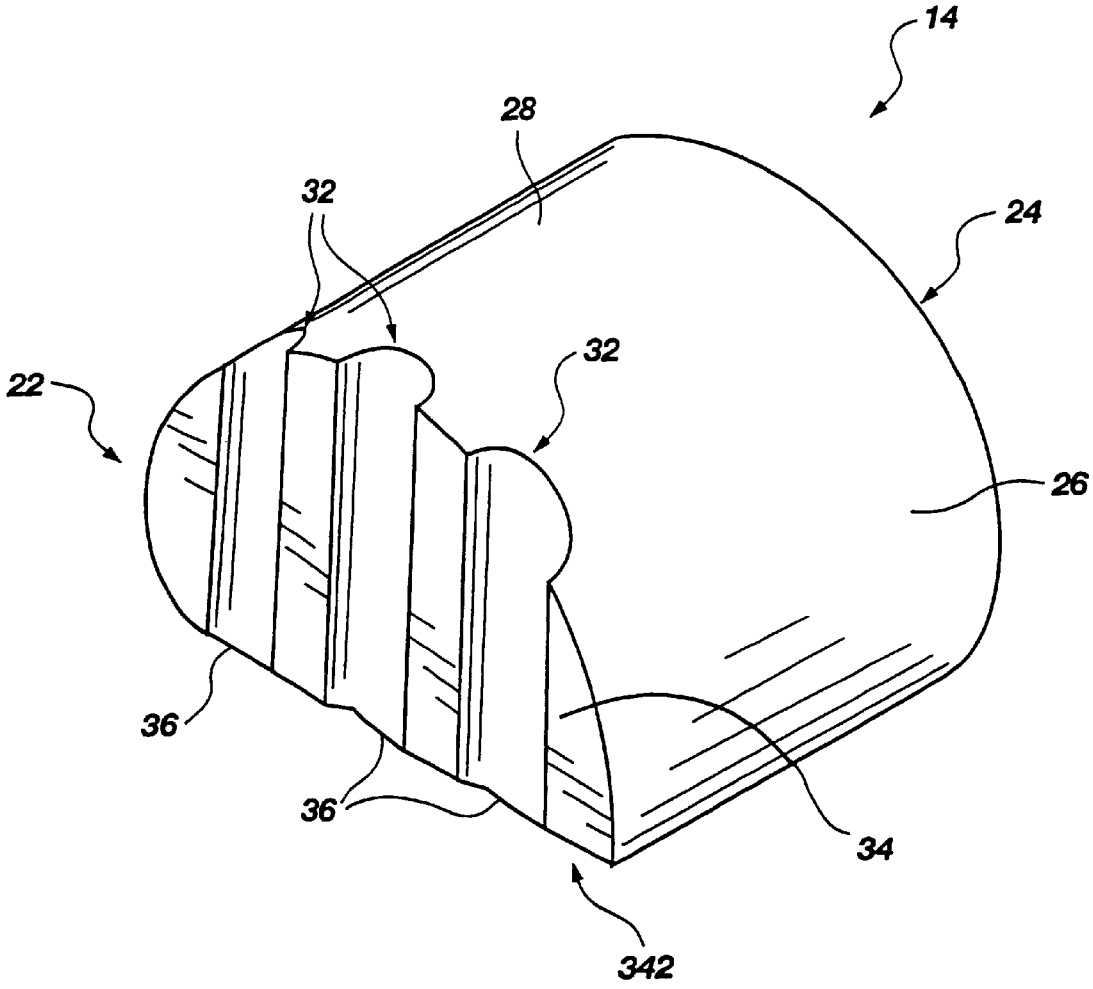
FIG. 12 is a perspective view of the substrate of FIG. 10 as viewed from the side normally secured to a bit face.

Referring now to FIGS. 6–8 of the drawings, features of a second cutter embodiment 100 according to the present invention are depicted. For clarity, features of second cutter embodiment 100 already identified with respect to first cutter embodiment 10 will be identified by like reference numerals.

Second cutter embodiment 100, according to the present invention, comprises a superabrasive volume 12 formed onto a supporting substrate 14 according to the aforementioned ultra-high temperature, ultra-high pressure techniques. The superabrasive volume 12 again preferably comprises a PDC, although it may optionally comprise a TSP or a cubic boron nitride compact. The supporting substrate 14 preferably comprises a cemented tungsten carbide structure, preformed and placed in a diamond press with diamond crystals and a catalyst.

Superabrasive volume 12 comprises a cutting face 16 extending in two dimensions substantially transverse to longitudinal axis L of cutter 100 and having a cutting edge 18 at a lateral periphery thereof. Superabrasive volume 12 also includes a contiguous jacket 20 extending rearwardly from cutting edge 18 over the side of substrate 14.

Substrate 14 is substantially cylindrical and includes a leading end 22, a trailing end 24, and a side periphery 26. A portion 28 of the side periphery 26 comprises a surface of revolution, while another portion 30 lies inset from the surface of revolution and defines the location of superabrasive jacket 20 on the side periphery 26 of substrate 14.

Leading end 22 of substrate 14 comprises an irregular surface including a plurality of mutually parallel grooves 32 in substantially planar surface 34 extending from side periphery 26 at a location substantially opposed to portion 30 of side perphery 26 of substrate 14, and toward jacket 20. Grooves 32 preferably include concave bottoms 36 and convex, radiused side borders 38 transitioning from substantially planar surface 34 to concave bottoms 36. Grooves 32 terminate in quarter-spherical concave ends 140 of substantially the same radius as concave bottoms 36, side borders 38 extending into concave end borders 138 of like radius between concave ends 140 and substantially planar surface 34. Alternatively, as noted with respect to cutter 10, grooves 32 may extend completely across leading end 22.

Portion 30 of the side periphery 26 comprises a plurality of axially-extending, circumferentially spaced grooves 150, between which lie axially-oriented ridges 152 of increasing radius with respect to axis L and of increasing cross-sectional area as ridges 152 extend away from leading end 22. The radially outer surfaces 154 of ridges 152 terminate short of the surface of revolution defined by portion 28 of the side periphery 26. Convex, radiused end borders 56 lead from substantially planar surface 34 of leading end 22 to leading edges of concave bottoms 158 of grooves 150 and leading edges of ridges 152. Unlike the bottoms 58 of grooves 50 of cutter 10, bottoms 158 of grooves 150 of cutter 100 are of decreasing radius as grooves 150 extend away from leading end 22. If, as noted above, leading end grooves 32 extend across leading end 22 to intersect some or all of side periphery grooves 150, the intersections of the mutually perpendicular grooves 32 and 150 may also be radiused. The borders 162 between ridges 152 and side groove bottoms 158 are also convex and radiused, as are the borders 164 respectively between grooves 150 and ridges 152 and semi-annular floor 166, which lies near trailing end 24 of substrate 14 and is substantially transverse to longitudinal axis L.

As best shown in FIG. 8, cutting face 16 of superabrasive volume 12 of cutter 100 may comprise a substantially planar leading surface 70 extending at least partially across leading end 22 of substrate 14, and may include a peripheral chamfer 72 at least adjacent cutting edge 18. As used herein, the term "substantially planar" includes not only flat leading surfaces but those of concave, convex, grooved, stepped, ridged and other configurations which nonetheless extend in two dimensions substantially transverse to longitudinal cutter axis L. Jacket 20 preferably includes a convex exterior surface 74 of substantially the same radius as that of portion 28 of side periphery 26 and coaxial therewith so that the substrate 14 and overlying jacket 20 define a substantially continuous surface of revolution. Due to the configuration of the side boundaries of portion 30 of side periphery 26 of substrate 14 of cutter 100, it should be noted that jacket 20 may taper to a slightly smaller width transverse to axis L as it extends away from the leading end of cutter 100.

It should be noted that, as with cutter 10, the material of superabrasive volume 12 of cutter 100 extends into both grooves 32 and 150, defining ribs which in substantial part provide the aforementioned irregular interfaces between the superabrasive volume 12 and substrate 14. The above-noted radially foreshortened nature of the ridges 152 provides a continuous shell of superabrasive material over the leading end ribs, while cutting face 16 extends in a continuous manner over the side ribs. Alternatively, although not currently preferred for all drilling applications, the ridges 152 may extend to the full radius of the cutter 100 so that the superabrasive material in grooves 150 comprises exposed longitudinally extending ribs.

As with cutter 10, cutter 100 may be mounted in a pocket on the face of a bit such as is shown in FIG. 1 so that superabrasive jacket 20 faces generally away from the bit face and the cemented tungsten carbide of substrate 14 on the inwardly-facing portion of side periphery 26, as well as on the trailing end 24 of substrate 14 are exposed for brazing cutter 10 into a pocket. Also, as with cutter 10, cutter 100 may be configured as a stud cutter, may employ a substrate having at least a portion of frustoconical configuration, or both, as desired.

Referring now to FIGS. 8 and 10–12 of the drawings, features of a third cutter embodiment 300 according to the present invention are depicted. For clarity, features of third cutter embodiment 300 already identified with respect to first and second cutter embodiments 10 and 100 will be identified by like reference numerals.

Third cutter embodiment 300 according to the present invention comprises a superabrasive volume 12 formed onto a supporting substrate 14 according to the aforementioned ultra-high temperature, ultra-high pressure techniques. The superabrasive volume 12 again preferably comprises a PDC, although it may optionally comprise a TSP or a cubic boron nitride compact. The supporting substrate 14 preferably comprises a cemented tungsten carbide structure, preformed and placed in a diamond press with diamond crystals and a catalyst.

The superabrasive volume 12, as with volumes 12 of cutters 10 and 100, comprises a cutting face 16 extending in two dimensions substantially transverse to longitudinal axis L of cutter 300 and having a cutting edge 18 at a lateral periphery thereof. The superabrasive volume 12 also includes a contiguous jacket 20 extending rearwardly from the cutting edge 18 over the side of substrate 14. FIG. 8 is a representation of the exterior appearance of cutter 300 as well as of cutter 100, and the superabrasive volume and its features on cutter 300 need not be further described at this juncture.

Substrate 14 is substantially cylindrical and includes a leading end 22, a trailing end 24, and a side periphery 26. A portion 28 of the side periphery 26 comprises a surface of revolution, while another portion 30 lies inset from the surface of revolution and defines the location of superabrasive jacket 20 on the side periphery 26 of substrate 14.

Leading end 22 of substrate 14 comprises an irregular surface including a plurality of mutually parallel grooves 32 in substantially planar surface 34 extending from side periphery 26 of substrate 14 at a location substantially opposed to portion 30 of side periphery 26, and toward jacket 20. Grooves 32 preferably include concave bottoms 36. Grooves 32 terminate in arcuate, concave ends 340 proximate the intersection of leading end 22 and portion 30 of side periphery 26, thus extending substantially across leading end 22.

The intersection 342 between leading end 22 and portion 30 of substrate 14 is substantially straight, transverse to longitudinal axis L and is substantially rounded or radiused. Portion 30 of the side periphery 26 comprises a plurality of substantially axially-extending, laterally-spaced side periphery grooves 350 in the surface of, and longitudinally shorter than, flat 330, which may be parallel to longitudinal axis L or inclined at a slight angle thereto. Grooves 350 may be, as shown, more tilted or inclined toward longitudinal axis L than flat 330 so as to be deeper at their leading ends. The trailing end 332 of flat 330 curves outwardly to the radius of portion 28 of side periphery 26 of substrate 14. Axially-oriented ridge 352 of substantially constant width lies between grooves 350. The radially outer surface 354 of ridge 352 is substantially coplanar with flat 330 and terminates short of the surface of revolution defined by portion 28 of the side periphery 26. As illustrated, grooves 350 lie between leading end grooves 32. If, as noted above with respect to cutters 10 and 100, leading end grooves 32 extend across leading end 22 to intersect some or all of side periphery grooves 350, the intersections of the substantially mutually transverse grooves 32 and 350 may also be radiused.

Again referring to FIG. 8, cutting face 16 of superabrasive volume 12 may comprise a substantially planar leading surface 70 extending at least partially across leading end 22 of substrate 14, and may include a peripheral chamfer 72 at least adjacent cutting edge 18. As used herein, the term "substantially planar" includes not only flat leading surfaces but those of concave, convex, grooved, stepped, ridged and other configurations which nonetheless extend in two dimensions substantially transverse to longitudinal cutter axis L. Jacket 20 preferably includes a convex exterior surface 74 of substantially the same radius as that of portion 28 of side periphery 26 and coaxial therewith so that the substrate 14 and overlying jacket 20 define a substantially continuous surface of revolution. Due to the configuration of the side boundaries of portion 30 of side periphery 26 of substrate 14 of cutter 300, it should be noted that jacket 20 may taper to a slightly smaller width transverse to axis L as it extends away from the leading end of cutter 300.

It should be noted that, as with cutters 10 and 100, the material of superabrasive volume 12 of cutter 300 extends into both grooves 32 and 350, defining ribs which in substantial part provide the aforementioned irregular interfaces between the superabrasive volume 12 and substrate 14. The above-noted radially foreshortened nature of ridge 352 provides a continuous shell of superabrasive material over the side ribs, while cutting face 16 extends in a continuous manner over the leading end ribs. Alternatively, although not currently preferred for all drilling applications, ridge 352 may extend to the radius of portion 28 of side periphery 26 and flat 330 may be eliminated so that a jacket 20 comprising adjacent ribs of superabrasive material, rather than a continuous jacket 20, is exhibited on the side periphery 26 of the cutter 300.

As with cutters 10 and 100, cutter 300 may be mounted in a pocket on the face of a bit such as is shown in FIG. 1 so that superabrasive jacket 20 faces generally away from the bit face and the cemented tungsten carbide of substrate 14 on the inwardly-facing portion of side periphery 26 as well as on the trailing end 24 of substrate 14 is exposed for brazing cutter 10 into a pocket. Also, as with cutters 10 and 100, cutter 300 may be configured as a stud cutter, may employ a substrate having at least a portion of frustoconical configuration, or both, as desired.

The invention as disclosed herein provides several notable advantages over state of the art cutters. First, the complex geometry of the superabrasive volume 12, with its cutting face 16 and contiguous jacket 20, results in beneficial compressive loading of the superabrasive material, whether normal loading attributable to weight on bit or tangential loading attributable to bit rotation predominates on the cutter. This advantage is particularly significant in the context of precluding formation of a continuous superabrasive lip transverse to the longitudinal axis of the cutter and along the cutting edge of the superabrasive table, which lip might be susceptible to catching on the formation and initiating delamination of the superabrasive table, as described above. Further, the irregular interfaces between the superabrasive volume 12 and the supporting substrate 14 lower residual tensile stresses (induced by the fabrication process) within the cutter at and adjacent the interfaces and isolate any regions of residual tensile stress so as to minimize the potential for cumulative stresses to cause cutter degradation and failure under loading. The ribs of superabrasive material extending into the substrate along the interfaces also provide additional superabrasive material volume to facilitate heat transfer from the superabrasive cutting face 16 and jacket 20, thus maintaining the superabrasive material in those regions at a lower temperature and reducing the potential for premature, heat-induced degradation of those regions as well as in the underlying substrate material. Use of a superabrasive jacket 20 contiguous with the cutting face 16 and located on the side periphery 26 of a cutter 10, 100 makes the cutter 10, 100 very wear-resistant in abrasive sands and affords protection to the carbide material of the substrate to substantially reduce the possibility of substrate heat-checking in limestones and other more ductile or elastic formations such as tougher mudstones or shales. Thus, physical support for the superabrasive table is maintained. Moreover, if the jacket 20 wears through (see FIG. 9) to a depth exposing the superabrasive ribs (90, 92 shown) respectively extending into the substrate grooves (32, 50 shown) and the surrounding superabrasive material of the still unworn portion 20*u* of jacket 20, the mix of superabrasive and substrate material provides an aggressive cutting action.

While the present invention has been described with respect to certain preferred embodiments, those of ordinary skill in the art will recognize and appreciate that it is not so limited. Additions or modification to, as well as deletions from, these embodiments may be made without departing from the scope of the invention as defined by the claims which follow. Features from one embodiment may likewise be combined with features from another embodiment. For example, the grooves may be of various configurations other than those disclosed, such as rectangular or substantially cylindrical, the ridges may likewise exhibit other geometries, and the superabrasive jacket may be more tapered, may exhibit other shapes such as half-circular or half-ellipsoidal, or may extend to the trailing end of the substrate. The cutting face may not extend across the entire leading end of the substrate. The cutter may be configured as a half-cylinder, or be formed in a tombstone or other desired shape.

What is claimed is:

1. A cutter for use in drilling a subterranean formation, comprising:

a substrate having a longitudinal axis, a leading end, a side periphery including at least a partial surface of revolution and a trailing end, at least a portion of the leading end comprising an irregular surfaces, a portion of the side periphery comprising an irregular surface extending rearwardly of the leading end, and at least a portion of the irregular surface of the leading end being radially adjacent a portion of the side periphery opposite the irregular surface portion of the side periphery; and a superabrasive volume extending over at least the irregular surface portion of the leading end of the substrate to define a superabrasive cutting face extending in two dimensions transverse to the longitudinal axis and having a peripheral cutting edge, the superabrasive volume extending contiguously with and rearwardly from the cutting edge over the irregular surface portion of the side periphery of the substrate to a greater longitudinal extent than on the side periphery opposite the irregular surface portion of the side periphery to define a superabrasive jacket of non-uniform longitudinal extent thereover.

2. The cutter of claim 1, wherein the at least the portion of the leading end of the substrate comprising an irregular surface comprises at least one groove in the leading end and the superabrasive volume extending into the at least one groove.

3. The cutter of claim 2, wherein the at least one groove extends from a portion of the side periphery of the substrate opposite the irregular surface portion of the side periphery toward the irregular surface portion of the side periphery.

4. The cutter of claim 3, wherein the at least one groove extends across the leading end of the substrate.

5. The cutter of claim 1, wherein the irregular surface portion of the side periphery of the substrate comprises a plurality of grooves and the superabrasive volume extending into the grooves of the plurality.

6. The cutter of claim 5, wherein the plurality of grooves is substantially axially oriented and laterally separated.

7. The cutter of claim 6, wherein the grooves of the plurality are separated by at least one ridge of a radial extent less than a radius of the at least partial surface of revolution of the side periphery and the superabrasive volume extends over the at least one ridge.

8. The cutter of claim 7, wherein the at least one ridge is of substantially constant cross-section.

9. The cutter of claim 7, wherein the at least one ridge is of a cross-section which increases between a first end proximate the leading end of the substrate and a second end closer to the trailing end of the substrate.

10. The cutter of claim 1, wherein the irregular surface portion of the side periphery extends between the leading end of the substrate and a location short of the trailing end of the substrate.

11. The cutter of claim 10, wherein the superabrasive jacket is substantially coextensive with the irregular surface portion of the side periphery.

12. The cutter of claim 1, wherein the superabrasive jacket includes a continuous, arcuate exterior surface of a radius substantially equal to a radius of the at least partial surface of revolution of the side periphery.

13. The cutter of claim 1, wherein the leading end comprises a first plurality of grooves defining the at least a portion of the leading end comprising an irregular surface, the first plurality of grooves extending from the side periphery of the substrate opposite the irregular surface portion of the side periphery toward the irregular surface portion of the side periphery, the irregular surface portion of the side periphery comprises a second plurality of substantially axially oriented, laterally spaced grooves, and the superabrasive volume extends into the grooves of the first and second pluralities.

14. The cutter of claim 13, wherein at least some of the grooves of the first plurality extend across the leading end to intersect grooves of the second plurality.

15. The cutter of claim 13, wherein the grooves of the second plurality are separated by at least one ridge of a radial extent less than a radius of the at least partial surface of revolution of the side periphery and the superabrasive volume extends over the at least one ridge.

16. The cutter of claim 15, wherein the at least one ridge is of substantially constant cross-section.

17. The cutter of claim 15, wherein the at least one ridge is of a cross-section which increases between a first ridge end proximate the leading end of the substrate and a second ridge end closer to the trailing end of the substrate.

18. The cutter of claim 15, wherein the irregular surface portion of the side periphery extends between the leading end of the substrate and a location short of the trailing end of the substrate.

19. The cutter of claim 15, wherein the superabrasive jacket is substantially coextensive with the irregular surface portion of the side periphery.

20. The cutter of claim 15, wherein the jacket includes a continuous, arcuate exterior surface of a radius substantially equal to a radius of the at least partial surface of revolution of the side periphery.

21. A rotary drill bit for drilling a subterranean formation, comprising:

a bit body having a face at one end and a structure for connecting the rotary drill bit to a drill string at another end;

at least one cutter carried on the face and comprising:

a substrate having a longitudinal axis, a leading end, a side periphery including at least a partial surface of revolution and a trailing end, at least a portion of the leading end comprising an irregular surface, a portion of the side periphery comprising an irregular surface extending rearwardly of the leading end, and at least a portion of the irregular surface of the leading end being radially adjacent a portion of the side periphery opposite the irregular surface portion of the side periphery; and a superabrasive volume extending over at least the irregular surface portion of the leading end of the substrate to define a superabrasive cutting face extending in two dimensions transverse to the longitudinal axis and having a peripheral cutting edge, the superabrasive volume extending contiguously with and rearwardly from the peripheral cutting edge over the irregular surface portion of the side periphery of the substrate to a greater longitudinal extent than on the side periphery opposite the irregular surface portion of the side periphery to define a superabrasive jacket of non-uniform longitudinal extent thereover; the at least one cutter carried on the face being in an orientation with the superabrasive cutting face facing thereof generally in a direction of bit rotation and the superabrasive jacket thereof facing generally away from the face.

22. The rotary drill bit of claim 21, wherein the at least the portion of the leading end of the substrate comprising an irregular surface comprises at least one groove in the leading end and the superabrasive volume extending into the at least one groove.

23. The rotary drill bit of claim 22, wherein the at least one groove extends from the side periphery of the substrate opposite the irregular surface portion of the side periphery toward the irregular surface portion of the side periphery.

24. The rotary drill bit of claim 23, wherein the at least one groove extends across the leading end of the substrate.

25. The rotary drill bit of claim 21, wherein the irregular surface portion of the side periphery of the substrate comprises a plurality of grooves and the superabrasive volume extending into grooves of the plurality.

26. The rotary drill bit of claim 25, wherein at least one of the plurality of grooves is substantially axially oriented and laterally spaced.

27. The rotary drill bit of claim 26, wherein the grooves of the plurality are separated by at least one ridge of a radial extent less than a radius of the at least partial surface of revolution of the side periphery and the superabrasive volume extends over the at least one ridge.

28. The rotary drill bit of claim 27, wherein the at least one ridge is of substantially constant cross-section.

29. The rotary drill bit of claim 27, wherein the at least one ridge is of a cross-section which increases between a first end proximate the leading end of the substrate and a second end closer to the trailing end of the substrate.

30. The rotary drill bit of claim 21, wherein the irregular surface portion of the side periphery extends between the leading end of the substrate and a location short of the trailing end of the substrate.

31. The rotary drill bit of claim 30, wherein the superabrasive jacket is substantially coextensive with the irregular surface portion of the side periphery.

32. The rotary drill bit of claim 21, wherein the superabrasive jacket includes a continuous, arcuate exterior surface of a radius substantially equal to a radius of the at least partial surface of revolution of the side periphery.

33. The rotary drill bit of claim 21, wherein the leading end comprises a first plurality of mutually parallel grooves defining the at least a portion of the leading end comprising an irregular surface, the first plurality of grooves extending from the side periphery of the substrate opposite the irregular surface portion of the side periphery toward the irregular surface portion of the side periphery, the irregular surface portion of the side periphery comprises a second plurality of substantially axially oriented, laterally spaced grooves and the superabrasive volume extends into the grooves of the first and second pluralities.

34. The rotary drill bit of claim 33, wherein at least some of the grooves of the first plurality extend across the leading end to intersect grooves of the second plurality.

35. The rotary drill bit of claim 33, wherein the grooves of the second plurality are separated by at least one ridge of a radial extent less than a radius of the at least partial surface of revolution of the side periphery and the superabrasive volume extends over the at least one ridge.

36. The rotary drill bit of claim 35, wherein the at least one ridge is of substantially constant cross-section.

37. The rotary drill bit of claim 35, wherein the at least one ridge is of a cross-section which increases between a first ridge end proximate the leading end of the substrate and a second ridge end closer to the trailing end of the substrate.

38. The rotary drill bit of claim 35, wherein the irregular surface portion of the side periphery extends between the leading end of the substrate and a location short of the trailing end of the substrate.

39. The rotary drill bit of claim 35, wherein the superabrasive jacket is substantially coextensive with the irregular surface portion of the side periphery.

40. The rotary drill bit of claim 35, wherein the superabrasive jacket includes a continuous, arcuate exterior surface of a radius substantially equal to a radius of the at least partial surface of revolution of the substrate.

41. A cutter for use in drilling subterranean formation, comprising: a substrate comprising:

a longitudinal axis, a generally planar leading end, a side periphery including at least a partial surface of revolution, and a trailing end, at least a portion of the generally planar leading end comprising an irregular end surface, the side periphery including a radially inset portion longitudinally proximate the generally planar leading end being radially inset from a remainder of the side periphery longitudinally proximate the trailing end, the radially inset portion of the side periphery comprising an irregular side surface portion extending rearwardly of the generally planar leading end, and at least a portion of the irregular end surface of the generally planar leading end being radially adjacent a portion of the side periphery opposite the irregular side surface portion of the side periphery; and a superabrasive volume extending over at least the irregular end surface of the generally planar leading end of the substrate to define a superabrasive cutting face extending in two dimensions transverse to the longitudinal axis and having a peripheral cutting edge, the superabrasive volume extending contiguously with and rearwardly from the peripheral cutting edge over at least the irregular side surface portion of the radially inset portion of the side periphery of the substrate to a greater longitudinal extent than on the side periphery opposite the irregular side surface portion of the radially inset portion of the side periphery of the substrate to define a superabrasive jacket of non-uniform longitudinal extent thereover.

42. The cutter of claim 41, wherein the irregular end surface comprises at least one groove in the generally planar leading end extending from the side periphery opposite the irregular side surface portion toward and short of the irregular side surface portion and the superabrasive volume extends into the at least one groove in the generally planar leading end.

43. The cutter of claim 42, wherein the at least one groove of the irregular end surface comprises a plurality of grooves and the superabrasive volume extends into each of the plurality of grooves.

44. The cutter of claim 43, wherein the plurality of grooves are generally mutually parallel and laterally separated.

45. The cutter of claim 44, wherein at least one of the plurality of grooves has convex radiused borders between the at least one groove of the plurality and at least one groove of the plurality terminates so as to have a concave end.

46. The cutter of claim 41, wherein the radially inset portion of the side periphery terminates at an annular floor extending inwardly toward, and substantially transverse to, the longitudinal axis from the remainder of the side periphery and wherein the irregular side surface portion of the radially inset portion of the side periphery comprises at least one groove extending from the generally planar leading end and terminating at the annular floor and the superabrasive volume extends into the at least one groove of the irregular side surface portion.

47. The cutter of claim 46, wherein the at least one groove of the irregular side surface portion comprises a plurality of grooves being substantially axially oriented and circumferentially spaced apart and the superabrasive volume extends into each of the plurality of grooves of the irregular side surface portion.

48. The cutter of claim 46, wherein a portion of the annular floor generally adjacent the irregular side surface portion is positioned a further longitudinal distance away from the generally planar leading end than a portion of the annular floor generally diametrically opposite the irregular side surface portion.

49. The cutter of claim 48, wherein the annular floor slopes from the portion of the annular floor generally adjacent the irregular side surface portion to the portion of the annular floor generally diametrically opposite the irregular side surface portion.

50. The cutter of claim 47, wherein at least some of the plurality of grooves in the irregular side surface portion are separated by at least one axially oriented ridge having a radial extent less than the remaining side periphery proximate the trailing end.

51. The cutter of claim 50, wherein at least one of the plurality of the grooves and the at least one ridge of the irregular side surface portion mutually comprise a convex, radiused border therebetween.

52. The cutter of claim 50, wherein at least one of the plurality of the grooves and the at least one ridge of the irregular side surface portion each comprise a convex, radiused end border mutual to the generally planar leading end.

53. The cutter of claim 50, wherein the plurality of the grooves and the at least one ridge of the irregular side surface portion each comprise a convex, radiused border mutual to the annular floor.

54. The cutter of claim 50, wherein at least one of the plurality of grooves of the irregular side surface portion comprises a concave bottom.

55. The cutter of claim 50, wherein the at least one axially oriented ridge of the irregular side surface portion comprises a plurality of ridges, each having a substantially constant cross-section.

56. The cutter of claim 45, wherein the superabrasive jacket is substantially coextensive with the irregular side surface of the leading end and the radially inset portion of the side periphery and terminates at the annular floor, the superabrasive jacket including a continuous, arcuate exterior surface of a radius substantially equal to a radius of the remainder of the side periphery proximate the trailing end.

57. A rotary drill bit for drilling a subterranean formation, comprising:

a bit body having a face at one end and structure for connecting the rotary drill bit to a drill string at another end;

at least one cutter carried on the face and comprising:

a substrate including a longitudinal axis, a generally planar leading end, a side periphery including at least a partial surface of revolution, and a trailing end, at least a portion of the generally planar leading end comprising an irregular end surface, the side periphery including a radially inset portion longitudinally proximate the generally planar leading end being radially inset from a remainder of the side periphery longitudinally proximate the trailing end, the radially inset portion of the side periphery comprising an irregular side surface portion extending rearwardly of the generally planar leading end, and at least a portion of the irregular end surface of the generally planar leading end being radially adjacent a portion of the side periphery opposite the irregular side surface portion of the radially inset portion of the side periphery of the substrate; and a superabrasive volume extending over at least the irregular end surface of the generally planar leading end of the substrate to define a superabrasive cutting face extending in two dimensions traverse to the longitudinal axis and having a peripheral cutting edge, the superabrasive volume extending contiguously with and rearwardly from the superabrasive cutting edge over at least the irregular side surface portion of the radially inset portion of the side periphery of the substrate to define a superabrasive jacket of non-uniform longitudinal extent thereover.

58. The rotary drill bit of claim 57, wherein the irregular end surface comprises at least one groove in the generally planar leading end extending from the side periphery opposite the irregular side surface toward and short of the irregular side surface and the superabrasive volume extends into the at least one groove in the generally planar leading end.

59. The rotary drill bit of claim 58, wherein the at least one groove of the irregular end surface comprises a plurality of grooves and the superabrasive volume extends into each of the plurality of grooves.

60. The rotary drill bit of claim 59, wherein the plurality of grooves are generally mutually parallel and laterally separated.

61. The rotary drill bit of claim 60, wherein at least one of the plurality of grooves have convex radiused borders between the at least one groove of the plurality and at least one groove of the plurality terminates so as to have a concave end.

62. The rotary drill bit of claim 57, wherein the radially inset portion of the side periphery terminates at an annular floor extending inwardly toward, and substantially transverse to, the longitudinal axis from the remainder of the side periphery and wherein the irregular side surface of the radially inset portion of the side periphery comprises at least one groove extending from the generally planar leading end and terminating at the annular floor and the superabrasive volume extends into the at least one groove of the irregular side surface.

63. The rotary drill bit of claim 62, wherein the at least one groove of the irregular side surface comprises a plurality of grooves being substantially axially oriented and circumferentially spaced apart and the superabrasive volume extends into each of the plurality of grooves of the irregular side surface.

64. The rotary drill bit of claim 62, wherein a portion of the annular floor generally adjacent the irregular side surface is positioned a further longitudinal distance away from the generally planar leading end than a portion of the annular floor generally diametrically opposite the irregular side surface.

65. The rotary drill bit of claim 64, wherein the annular floor slopes from the portion of the annular floor generally adjacent the irregular side surface to the portion of the annular floor generally diametrically opposite the irregular side surface.

66. The rotary drill bit of claim 63, wherein at least some of the plurality of grooves in the irregular side surface are separated by at least one axially oriented ridge having a radial extent less than the remaining side periphery proximate the trailing end.

67. The rotary drill bit of claim 66, wherein at least one of the plurality of the grooves and the at least one ridge of the irregular side surface mutually comprise a convex, radiused border therebetween.

68. The rotary drill bit of claim 66, wherein at least one of the plurality of the grooves and the at least one ridge of the irregular side surface each comprise a convex, radiused end border mutual to the generally planar leading end.

69. The rotary drill bit of claim 66, wherein the plurality of the grooves and the at least one ridge of the irregular side surface each comprise a convex, radiused border mutual to the annular floor.

70. The rotary drill bit of claim 66, wherein at least one of the plurality of grooves of the irregular side surface comprises a concave bottom.

71. The rotary drill bit of claim 66, wherein the at least one axially oriented ridge of the irregular side surface comprises a plurality of ridges, each having a substantially constant cross-section.

72. The rotary drill bit of claim 62, wherein the superabrasive jacket is substantially coextensive with the generally planar leading end and the radially inset portion of the side periphery and terminates at the annular floor, the superabrasive jacket including a continuous, arcuate exterior surface of a radius substantially equal to a radius of the remaining side periphery proximate the trailing end.

* * * * *

UNITED STATES PATENT AND TRADEMARK OFFICE

CERTIFICATE OF CORRECTION

PATENT NO. : 6,401,844 B1 
DATED : June 11, 2002
INVENTOR(S) : Michael L. Doster and Rudolf C.O. Pessier It is certified that error appears in the above-identified patent and that said Letters Patent is hereby corrected as shown below:

Column 10,
Line 64, after "the" and before "cutting" insert -- peripheral --

Column 12,
Line 6, before "jacket" insert -- superabrasive --

Column 15,
Line 21, after "the" and before "leading" insert -- generally planar --
Line 55, change "superabrasive" to -- peripheral --
Line 63, after "surface" and before "toward" insert -- portion --
Line 64, after "surface" and before "and" insert -- portion --

Column 16,
Line 15, after "surface" and before "of" insert -- portion --
Lines 20, 26, 28, 32, 37, 56 and 59, after "surface" insert -- portion --
Line 22, after "surface" and before "comprises" insert -- portion --
Line 35, after "surface" and before "to" insert -- portion --
Line 39, after "surface" and before "are" insert -- portion --
Line 45, after "surface" and before "mutually" insert -- portion --
Lines 49 and 53, after "surface" and before "each" insert -- portion --

Signed and Sealed this

Twenty-eighth Day of December, 2004

JON W. DUDAS
*Director of the United States Patent and Trademark Office*